US008648694B2

(12) United States Patent
Thumparthy

(10) Patent No.: US 8,648,694 B2
(45) Date of Patent: Feb. 11, 2014

(54) MULTIPARTY CONTROLLED REMOTE SECURITY LOCK SYSTEM

(75) Inventor: Viswanatha Rao Thumparthy, Bangalore (IN)

(73) Assignee: Sasken Communication Technologies Ltd., Bangalore (IN)

( * ) Notice: Subject to any disclaimer, the term of this patent is extended or adjusted under 35 U.S.C. 154(b) by 350 days.

(21) Appl. No.: 13/045,107

(22) Filed: Mar. 10, 2011

(65) Prior Publication Data

US 2012/0169460 A1 Jul. 5, 2012

(30) Foreign Application Priority Data

Dec. 29, 2010 (IN) ..... 4012/CHE/2010

(51) Int. Cl.
*G08C 19/00* (2006.01)

(52) U.S. Cl.
USPC ..... 340/5.52

(58) Field of Classification Search
USPC ..... 340/5.52, 540, 5.8, 5.6
See application file for complete search history.

(56) References Cited

U.S. PATENT DOCUMENTS

2003/0112118 A1* 6/2003 Raslan ..... 340/5.2
2004/0230807 A1* 11/2004 Baird et al. ..... 713/182
2007/0085655 A1* 4/2007 Wildman et al. ..... 340/5.53

* cited by examiner

*Primary Examiner* — Vernal Brown
(74) *Attorney, Agent, or Firm* — Rahman LLC

(57) ABSTRACT

A remotely controlled biometric based mechanism for security systems includes a remote security lock and uses an Onsite Controller (OC) and a plurality of Remote Controllers (RCs). Further, the OC is located at the site of the lock and the RCs may be located away from the site of the lock. The remote security lock employs 2-factor authentication mechanisms using smartcard access and biometric inputs. Randomized selection of a subset of controllers (RCs) who operate the lock is performed. The randomization enhances the scalability of the system, while keeping the security strength of the system as that of choosing the full set of controllers for operating the lock. A measure for determining the security level is also included, where the measure chosen is the number of controls that need to be broken to gain access to the controlled resource.

17 Claims, 8 Drawing Sheets

MULTIPARTY CONTROLLED REMOTE SECURITY LOCK SYSTEM

TECHNICAL FIELD

The embodiments herein relate to security systems and, more particularly, to remotely controlled and biometrically operated security systems.

BACKGROUND

Present day electronic security systems provide locking mechanisms that employ a combination of hardware and software. Such security mechanisms use PIN (Personal Identification Number) codes, sensors, smartcards, biometrics and a combination of the same in order to increase the levels of security provided by the security systems.

Present day security systems employ a single, two or three factor authentication. In single factor authentication the user is required to enter a PIN (Personal Identification Number). In two factor authentication the user is expected to insert a smartcard and enter the PIN. In three factor authentication the user is expected to produce a smartcard, enter a PIN and also provide a biometric, such as a fingerprint, to authenticate herself.

Further, some of these systems also operate under the custodianship of multiple persons, because with the increase of the number of persons controlling the security system, the level of security provided to the system increases. Since the system would require all the persons to be physically present to provide access to the system the level of security of the system is increased. Each person would physically authenticate the other persons. No one person would be able to access the security system independently. However, there are limitations associated with the existing multiple party systems. For example, in case of personal bank locker, all parties are to be physically present at the site for the operation of the locker. Even if one among the parties is not present at the site of the locker, the locker cannot be operated. This limitation could prove to be cumbersome in many scenarios. For example, if such a security system is employed at the loading bay of an ATM machine, then the parties controlling the access to the system have to be all present at the ATM machine at the same time.

In addition, if scalability of the security of the system is to be increased by adding more people controlling the lock or the same person is to be deployed at multiple locations, the requirement of physical presence of the people controlling the lock does not easily support the same.

SUMMARY

In view of the foregoing, an embodiment herein provides a method for providing access to a secure location, wherein the access is provided with one person at the secure location and other people operating from remote locations. In brief, the system achieves controlling the opening of a lock at a secure location by multiple persons, who need not all be physically present at the site. Thus the system is a multi-party controlled system. It is also remote as all the controlling parties need not be physically present at the site of the lock. The system also employs biometric comparisons to authenticate the users. Hence, it is also a biometric security lock. In total, the system being proposed is a multi-party controlled remote biometric security lock. The embodiment requires at least one person to be at the site of the lock, the on-site controller, and one or many parties who could be at remote sites, the remote controllers. The method comprises steps of the on-site controller inserting a smartcard and scanning her biometric details; details of the on-site controller being verified; a first encrypted message being generated using a first private key, if details of the on-site controller are verified; the first encrypted message being sent to at least one remote controller; the remote controller inserting a smartcard and scanning her biometric on receiving the encrypted message, on a terminal provided to her; details of the remote controller being verified; the first encrypted message being verified by the remote controller; a second encrypted message being generated using a second private key; and the second encrypted message being sent to the lock, granting access to the lock. Failure of any verification step generates a negative acknowledgement message by the second user and prevents access to the lock.

When more than one remote controller is associated with the lock, the first encrypted message is sent to all the remote controllers. Second to (N+1)th remote controllers, where N is the number of remote controllers, being verified; the first encrypted message being verified by the all the remote controllers; second to (N+1)th encrypted messages being generated by the remote controllers using corresponding private keys; the second to (N+1)th encrypted messages being sent to the lock; and received by the lock granting access to the lock. Failure of any verification step generates a negative acknowledgement message by the remote controllers and prevents access to the lock.

A number of remote controllers would be configured on the smartcard of the on-site controller. At the time of operation, a random subset of remote controllers is selected for granting access. The number of remote controllers chosen could be constant or variable, based on a configuration setting.

Embodiments further disclose a system for providing access to a secure location, wherein the access is provided to at least one on-site controller and at least one remote controller, the system comprising at least one means adapted for enabling a first user to scan his biometric details; verify details of the first user; generating a first encrypted message using a private key, if details of the first user are verified; sending the first encrypted message to a second user; and receiving a second encrypted message from the second user. The system is adapted for scanning biometric details of the first user on the first user scanning a smartcard and for using the private key from the smartcard. The system is adapted for selecting at least one of the remote controllers randomly from a set of remote controllers.

These and other aspects of the embodiments herein will be better appreciated and understood when considered in conjunction with the following description and the accompanying drawings.

BRIEF DESCRIPTION OF THE FIGURES

The embodiments herein will be better understood from the following detailed description with reference to the drawings, in which.

DETAILED DESCRIPTION OF EMBODIMENTS

Figure 1:
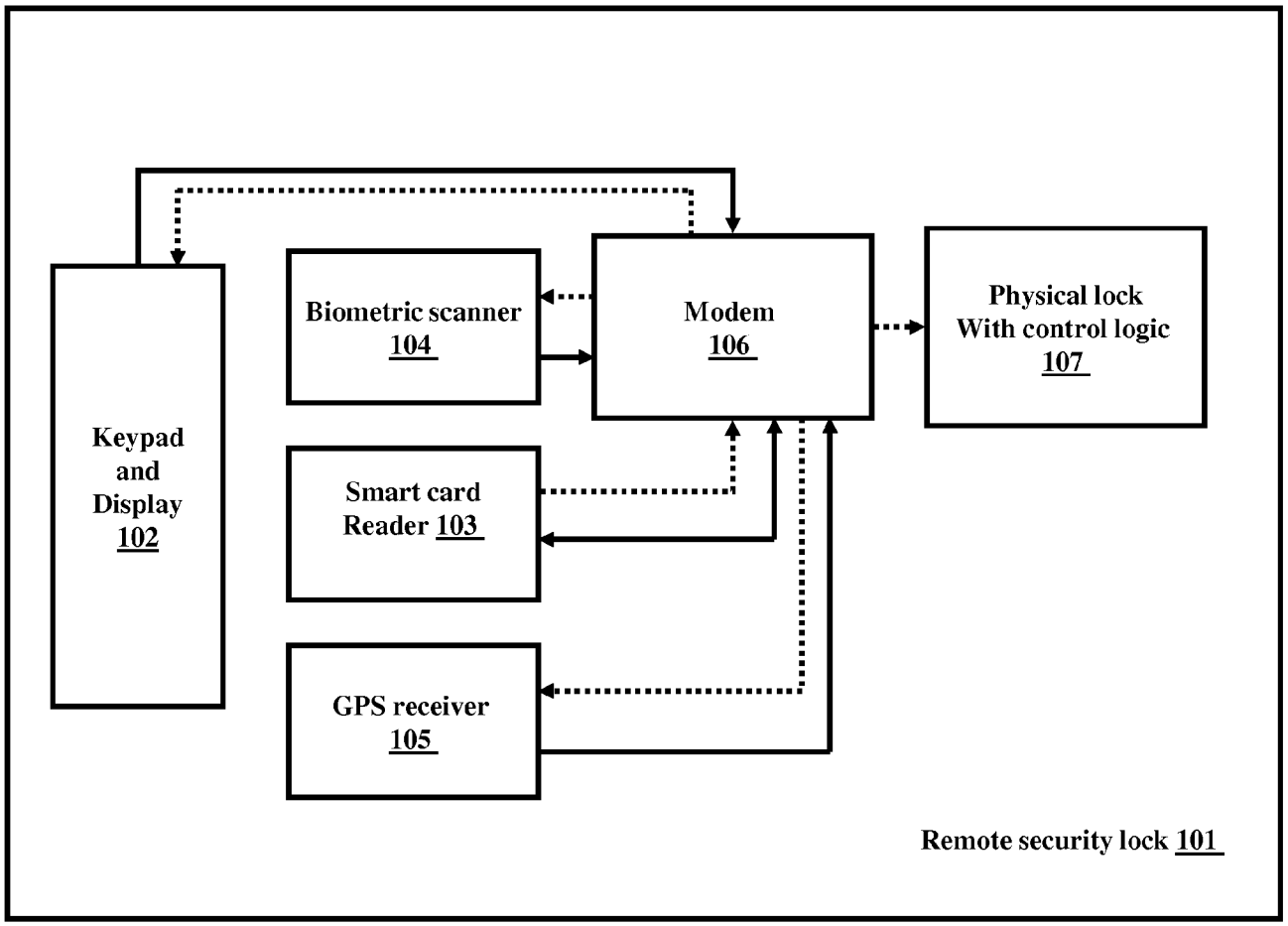
FIG. 1 depicts a device, which is placed near the remote security lock, according to an embodiment as disclosed herein.

The embodiments herein and the various features and advantages thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein disclose a remote security lock by providing systems and methods for accessing the lock. Referring now to the drawings, and more particularly to FIGS. 1 through 5, where similar reference numbers denote same features consistently throughout the figures, shown are the sample embodiments.

A remote security lock is disclosed. A system that supports the functionality of the lock and a method for enabling access to the lock are also disclosed. The method employs multiple parties for providing access to the lock. The method also enables a subset of people from the multiple parties to access the lock, while keeping the security level nearly equivalent to that of involving the full complement of the multiple parties. The access to the lock is provided to a set of people called Remote Controllers (RCs) and at least one Onsite Controller (OC). Remote controllers may include one or more than one person and may generally operate from a location that may not be necessarily the site of the security lock. In an embodiment, the RCs may also be located at the site of the lock. A set of the RCs may be operating from a location that is away from the site of the lock and a set of RCs may be at the location of the lock. Also, various combinations of a pre-defined set of RCs are possible. Onsite Controller is a single person who operates the lock at the site where the lock is present i.e., the OC is physically present at the site where the lock is used. The RCs and OC together may be referred to as controllers throughout the application.

Further, a measure for determining the security level is proposed. The measure chosen for this is the number of controls that need to be broken to gain access to the controlled resource. Let this measure be named security strength. To understand the enhancement provided by this security system which uses multiple controllers, with respect to other systems, the same measure may be used to quantify the security provided by those systems and then compared. For example, consider the conventional system of letting the cash boy open the physical lock and load the ATM. The security strength of this system would be 1, as access to the key is all that is required. Anyone getting the possession of the key would be able to open the ATM. It may be noted that the presence of the cash boy is not required for this operation. Thus, an attacker has to overcome one control (that of obtaining the key). On the other hand, consider the remote lock system with two controllers. To break this system an attacker has to have access to both the smartcards and the presence of both the individuals at different locations (to scan their fingerprints). Thus, the security strength of this system could be assigned as 4. Thus, it is an improvement of 4 times over the conventional (existing) system. The security of the system increases with the addition of each controller. The strength of the system goes up by 2 with the addition of each remote controller, i.e., the security strength increases linearly with the number of remote controllers. Thus, for an N RC system, the security strength is 2(N+1). To break this system an attacker has to have access to the smartcards of all the controllers and ensure the acquiescence of all the controllers to scan their biometrics.

Figure 2:
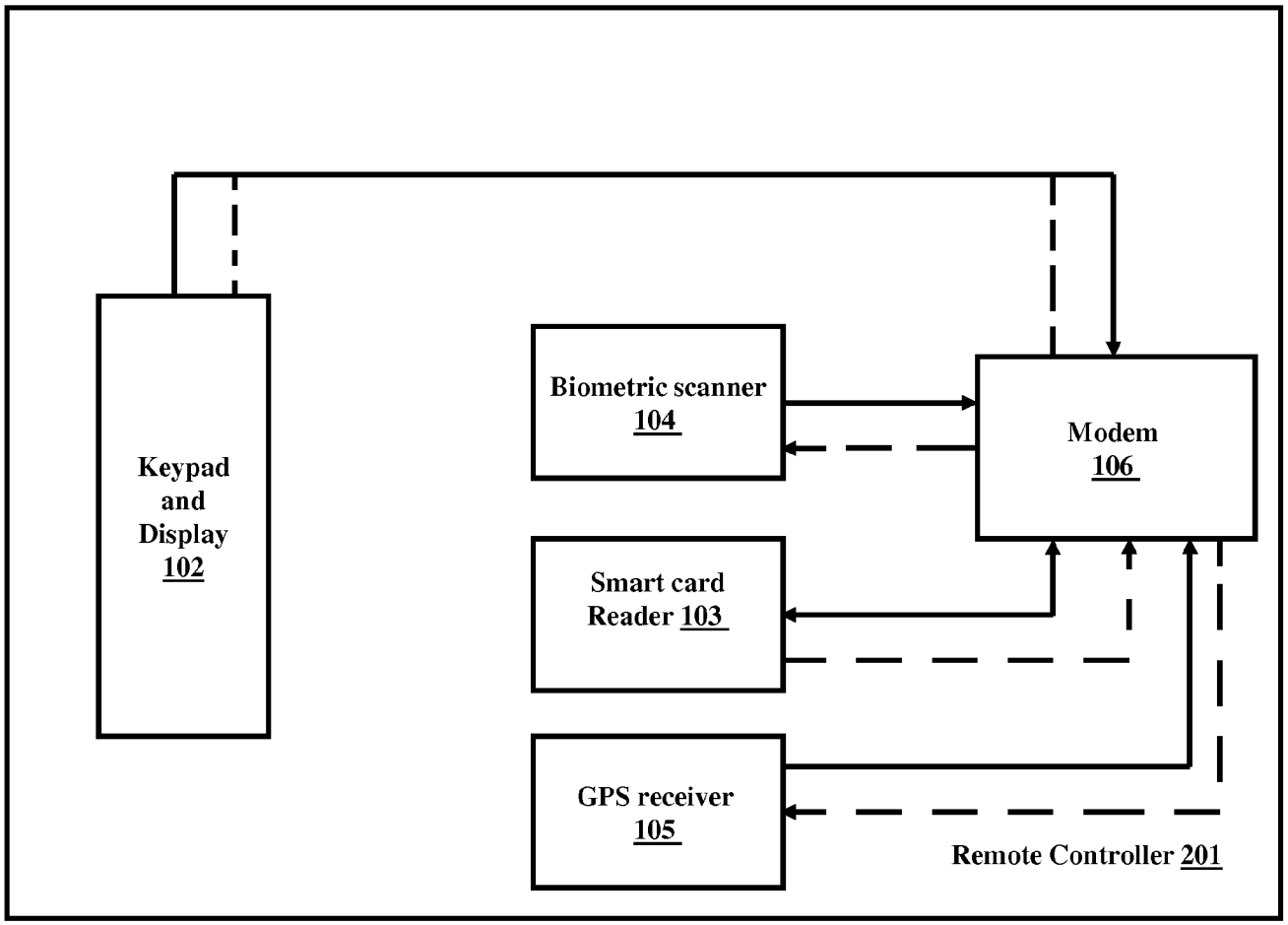
FIG. 2 depicts a device, which is in possession of every remote controller, according to an embodiment as disclosed herein.

The system employs a device, as depicted in FIG. 1, to be positioned near the lock. A similar device, as depicted in FIG. 2, is made available to each RC. The system employed for the lock uses multiple factors for the authentication of the parties who control the lock. In order to authenticate an OC or a RC, the system uses a smartcard. In addition, the system also employs biometric scan systems to authenticate the controllers who govern the lock. The smartcard of the OC stores details such as name of the controller, asset name(s), biometric verification data of the OC, the private key of the OC and public keys of all the RCs identified as remote controllers for the lock. The last of this information is dynamic and may change whenever the set of RCs is changed. The smartcard of the RCs stores the details such as name of the controller, asset name(s), biometric verification data of the owner, the private key of the owner and the public key of the OC. The last of this information is dynamic and may change whenever the OC is changed. The OC commences the operation of accessing the lock by inserting her smartcard and scanning her biometric on the device near the lock. The OC is authenticated by the device near the lock. Then a message is sent to the RCs expected to provide further permission to access the lock. The message is received on the device associated with the RC. The device authenticates the RC. This involves the inserting of the smartcard and scanning of the biometric. On authentication of the RC, the RC is provided access to the message received from the OC. The received message is verified by the RC. Then an acknowledgement message is sent by each RC. On non-authentication of the RC, a negative acknowledgement message is sent to the device near the lock. The device near the lock receives all the messages from the RCs and opens the lock if all of them are acknowledgement messages. The device near the lock does not open the lock if any received message is a negative acknowledgement message.

The method employs cryptosystems for encryption and digital signing of data exchanged between the devices. Information from the OC to RCs may include location of the lock, asset name, time, name of the OC, digital signature and so on. Information from the RCs to OC may include location of the controller, asset name, time, name of the RC, approval status (acknowledgement or negative acknowledgement), digital signature and so on. Further, the method also employs randomization techniques for selection of a non-zero subset of the RCs identified in the smartcard of the OC. With the randomization techniques employed, the number of RCs employed to control the lock is reduced. However, the security strength of the lock remains nearly equivalent to that provided by the full set of the RCs. Also, randomization introduces scalability into the system in that the number of RCs required providing access to the lock, without compromising the security strength, is reduced.

FIG. 1 depicts a remote security lock, according to an embodiment as disclosed herein. The remote security lock 101 may be employed at places where high levels of security are essential such as vaults, bank lockers, personal lockers, ATM loading bays, government offices, confidential document storage areas and so on. The components include a keypad and display 102, smartcard reader 103, biometric scanner 104, a GPS receiver 105, a wired or wireless modem 106 and physical lock with the logic control 107. The dashed lines in the figure depict the control flow and the thick lines represent data flow.

The keypad and display 102 at the site of the remote security lock 101 may be used by the OC to enter any details and to view the system messages. For instance, the OC may employ the keypad and display 102 in order to input the time of access of the lock. Similarly, the keypad and display 102 may be used by the OC to view the acknowledgement messages of the RCs.

The smartcard reader 103 may be a device that reads the details stored on the smartcard. The OC may insert her smartcard on the smartcard reader 103 during the access of the lock. The possession of the smartcard may be employed as one of the factors to authenticate the OC. Further, any changes made regarding the information of the OC such as her private key, RCs that the OC may contact and so on may be stored on the smartcard.

A biometric may be employed as one of the factors to authenticate the OC. The biometric scanner 104 may include a fingerprint scanner, palm scanner, iris scanner and so on. The biometric details of the OC are also stored on her smartcard. At the time of access of the lock, the same biometric detail is captured by the lock and a match is performed with the stored details. If there is a match, then the authentication is complete, else it is not. For the purposes of illustration, the biometric scanner 104 may be a fingerprint scanner. However, it is not limited to the same.

The GPS receiver 105 may be employed for tracking the location of the lock 101. This information may be communicated to the RCs, in the messages sent by the OC.

The modem 106 may be employed to send and receive messages from the lock to the RCs. When the OC is authenticated by the lock system, a message is produced to indicate the success of verification and sent to the RCs through the modem. The acknowledgement messages from the RCs are received through the modem.

The Physical lock with control logic 107 houses the lock. The Physical lock with control logic 107 also comprises of the logic that drives the operation of the lock. The control logic opens the lock only when all the conditions necessary for the opening of the lock have been satisfied.

FIG. 2 depicts a device, which is in the possession of every RC, according to an embodiment as disclosed herein. The components of the RC device 201 include a keypad and display 102, smartcard reader 103, biometric scanner 104, a GPS receiver 105 and a wired or wireless modem 106. The dashed lines in the figure depict the control flow and the thick lines represent data flow.

The RCs may use the keypad and display 102 in order to view the messages from the OC once the OC is verified by the system. The keypad and display 102 may be used by the RCs to enter details such as time of providing the permission for access of the lock. In addition, alerts and system messages may be viewed on the keypad and display 102.

The smartcard reader 103 may be a device that reads the details stored on the smartcard. The RCs may insert their smartcard on their respective smartcard reader 103 during the access of the lock. The possession of the smartcard may be employed as one of the factors to authenticate the RC. Further, any changes made regarding the information of the RC such as her private key, OCs that may contact the RC and so on may be stored on the smartcard.

A biometric may be employed as one of the factors to authenticate the RC. The biometric scanner 104 may include a fingerprint scanner, palm scanner, iris scanner and so on. The biometric details of the RC are stored on her smartcard. At the time of access of the lock, the same biometric detail is captured by the device 201 in possession of the RC and a match is performed with the stored details. If there is a match, then the authentication is complete, else it is not. For the purposes of illustration, the biometric scanner 104 may be a fingerprint scanner however it is not limited to the same.

The GPS receiver 105 may be employed for tracking the location of the RC using the RC device 201. This information may be communicated to the OC in the acknowledgement messages, for the purpose of logging.

The modem 106 may be employed to send and receive messages from the lock to the RCs. When the OC is authenticated by the lock system, a message is produced to indicate the success of verification and received by the RCs through the modem. The acknowledgement messages from the RCs are sent through the modem.

Figure 3:
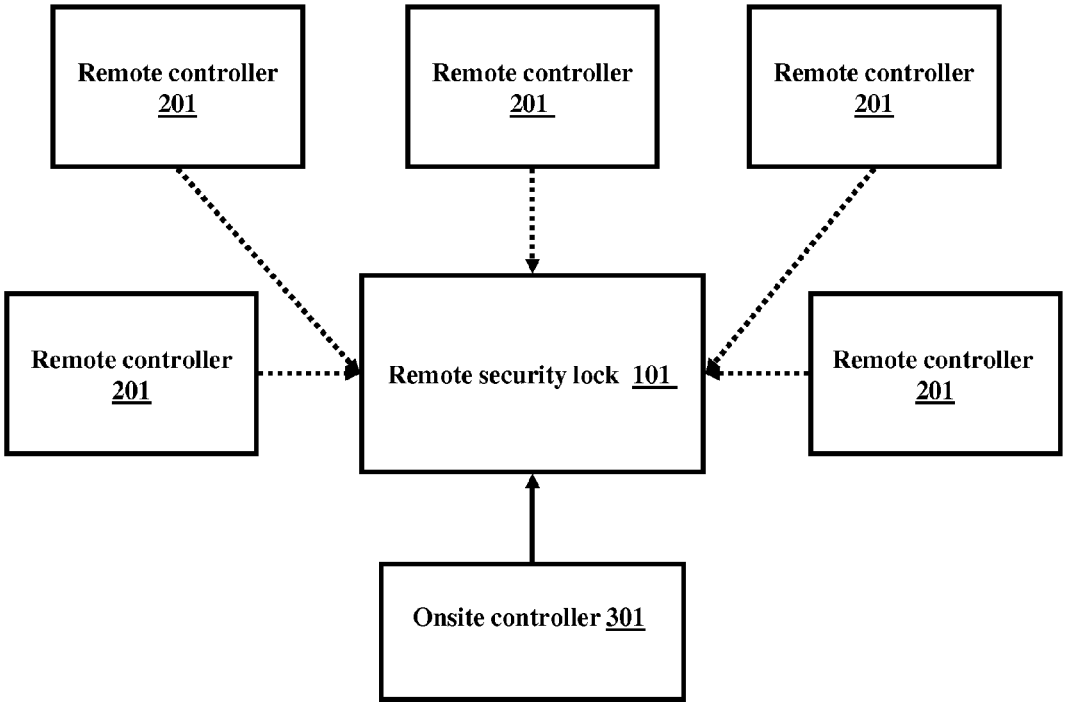
FIG. 3 is a chart depicting the multiple parties controlling the access to the remote security lock, according to an embodiment as disclosed herein.

FIG. 3 is a block diagram depicting the remote security lock at a location, according to an embodiment as disclosed herein. The remote security lock 101 may be used at places where high levels of security is required such as ATM loading bays, lockers, bank vaults and so on. Opening the remote security lock 101 is initiated by OC 301, who operates at the security location where the remote security lock 101 is deployed. In addition, the access is also controlled by at least one RC 201 who operates the lock from a remote location. The lock operates on a multiple party control mechanism and thus employs a plurality of RCs 201.

The OC 301 refers to the person who is present at the resource or asset that should be accessed. The system assigns at least one person to work as OC 301.

The RCs 201 may be people who operate the lock from remote locations or locations that are away from the site of the remote security lock 101. The system may assign any number of persons as RCs 201. Also, all the RCs 201 are not required to control the opening of the lock, a random subset (non-zero subset) of RCs may be chosen from the defined set of RCs 201 to open the remote security lock 101. It may be noted that the security strength of the lock, when a random subset of RCs is chosen from the full set of RCs, is nearly the same as that when all RCs are deployed on providing the control to the access of the lock 101.

Figure 4:
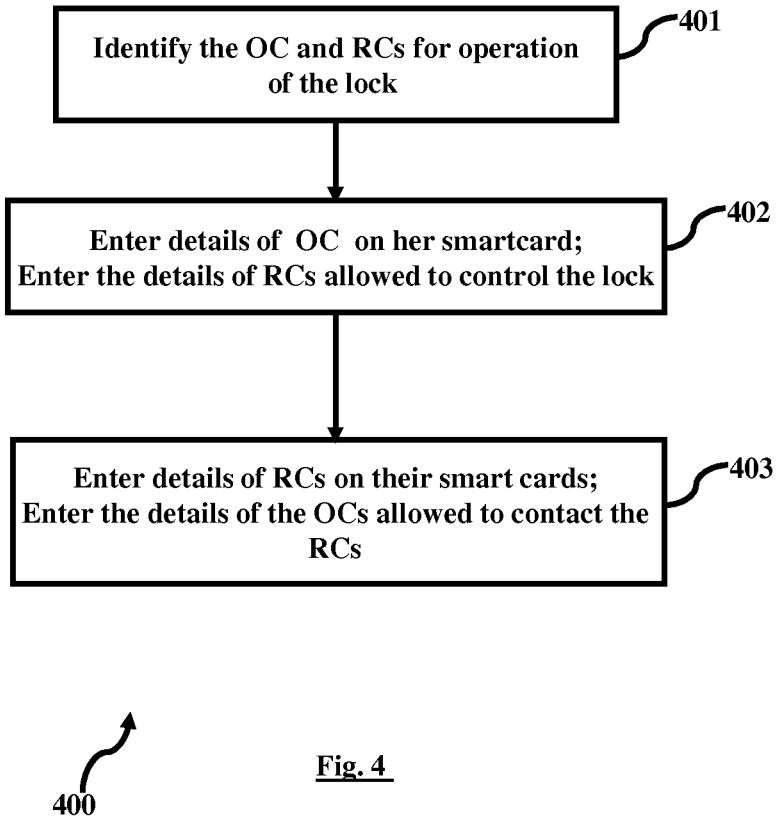
FIG. 4 is a flow chart depicting a process for configuring the remote security lock, according to an embodiment as disclosed herein.
Figure 5A:
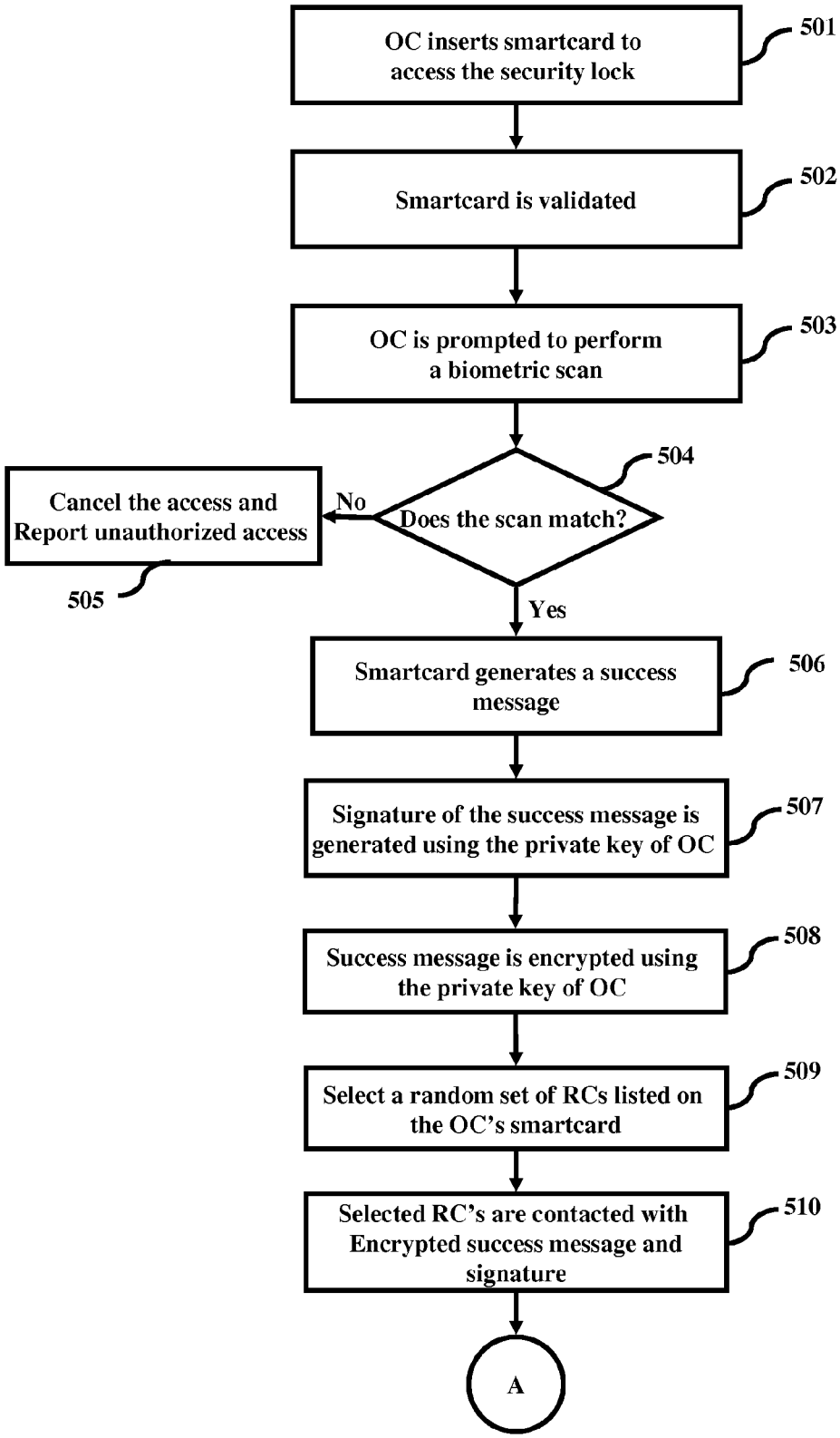
FIG. 5 is a flow chart depicting the process of providing access to the remote security lock, according to an embodiment as disclosed herein.
Figure 5B:
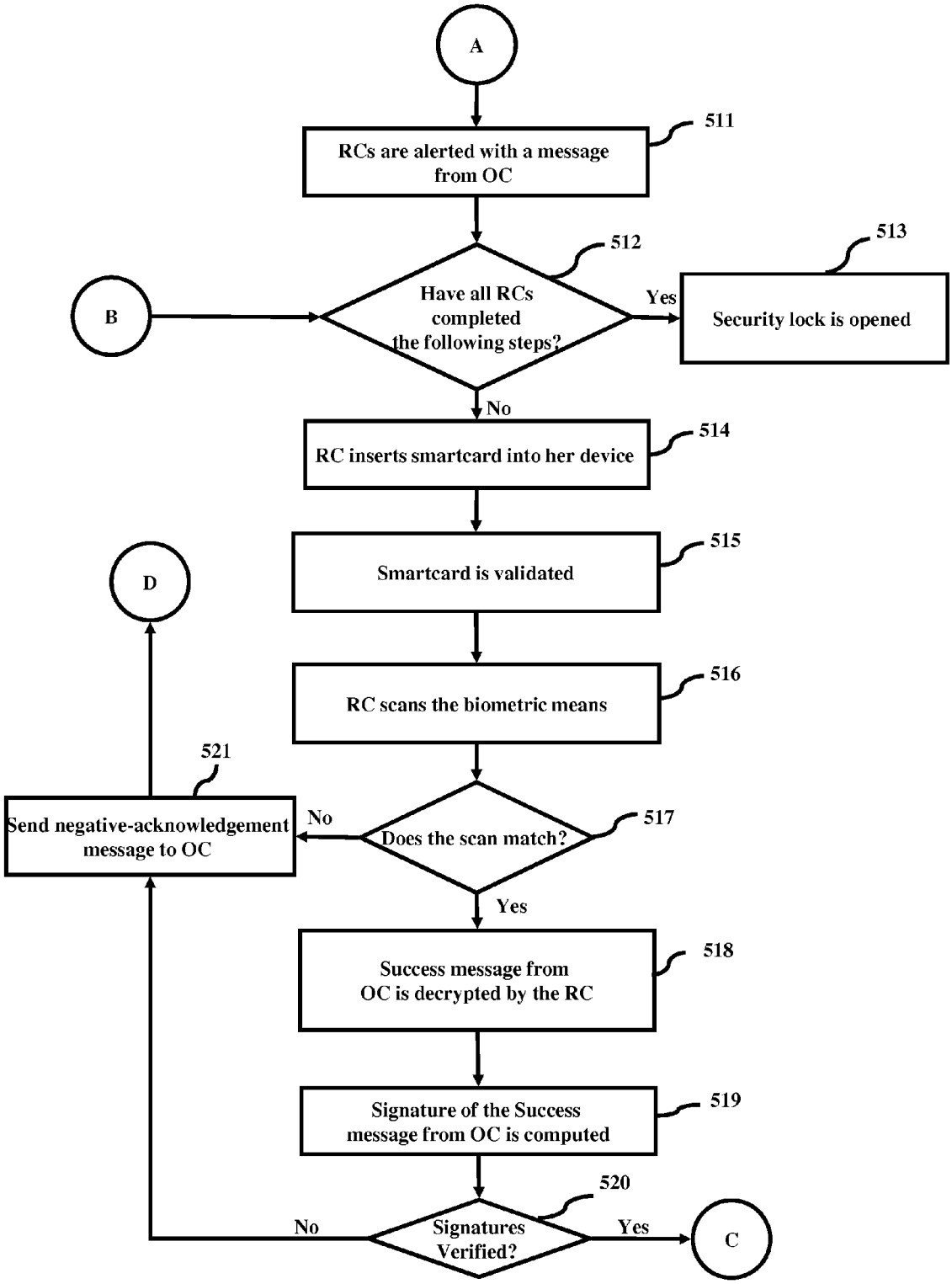
Figure 5C:
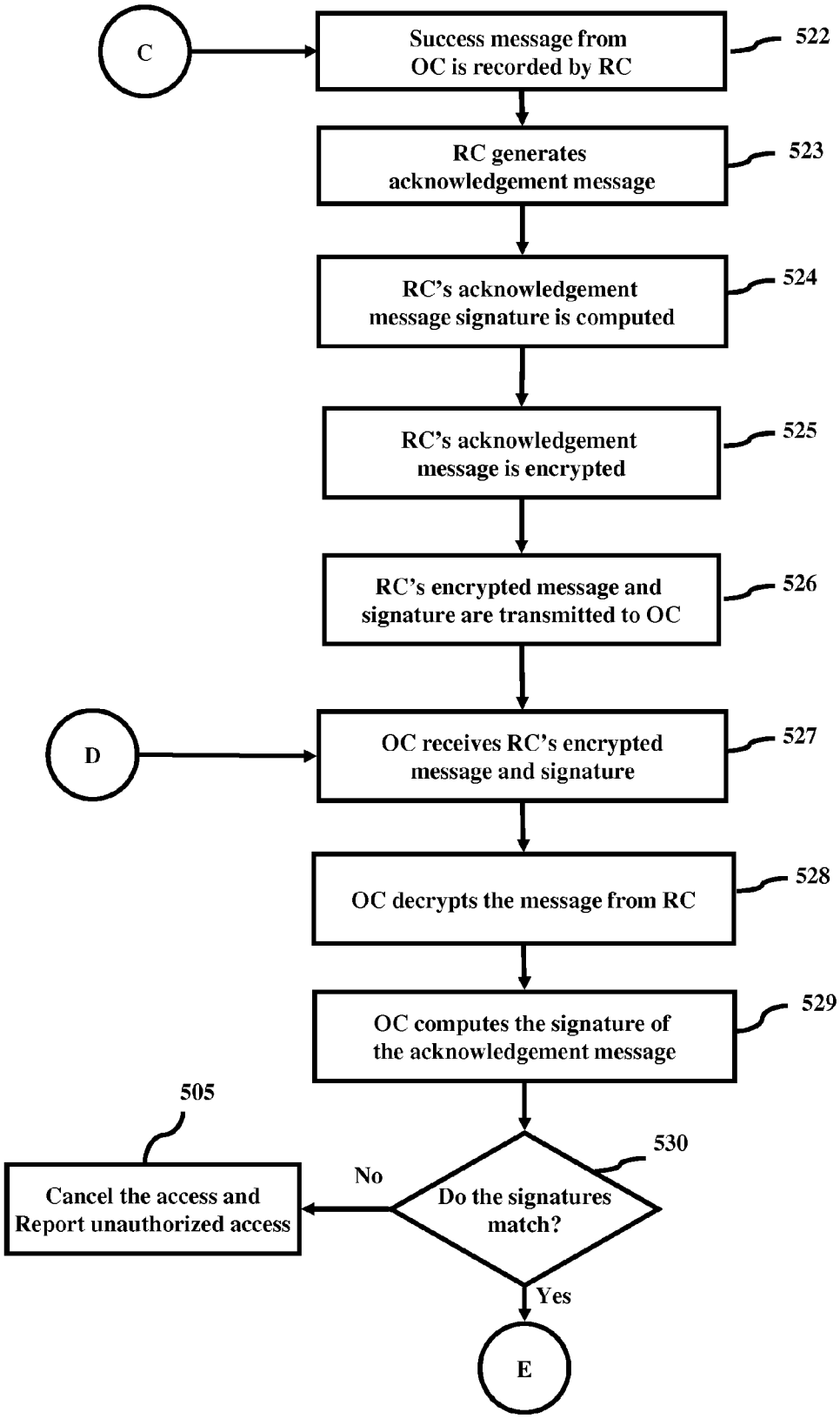
Figure 5D:
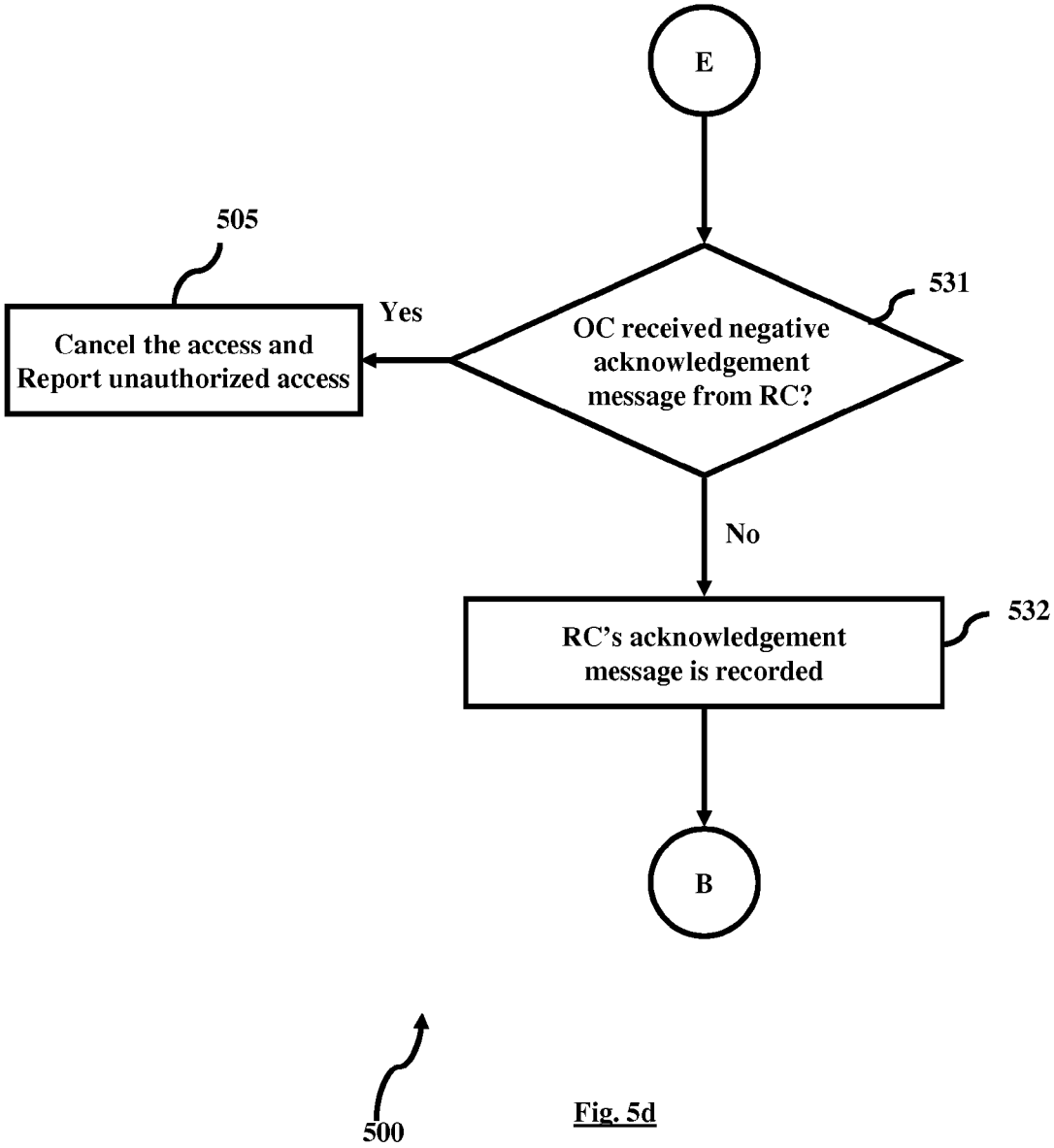

FIG. 4 is a flow chart depicting a process for configuring the remote security lock, according to an embodiment as disclosed herein. The configuration may be performed on a computer. At the stage of configuration, the remote security lock 101 may be configured for a single time use or multiple time use. Configuration involves identification of OC and RCs and registering their details into their smart cards. All the controllers are provided with a smart card. The system identifies (401) the OC and the RCs who would be authorized to access the remote security lock 101. The controllers chosen may be an OC 301 and a set of the RCs 201. Once the controllers are chosen, the details of the controllers are entered on their respective smartcards. The details of OC 301 are entered (402) on her smart card. The details include asset name, biometric information of the OC 301, private key of the OC 301 and the public keys of each RC 201 identified in 401. The details such as biometric information, private key may be, typically, entered only once. The biometric information may include fingerprint details of the OC so that the same may be used later for her authentication. Private Key is the unique key of the OC, as defined by a Public Key Infrastructure (PKI). The public keys of the RCs 201 may vary dynamically and may be updated as and when the information changes or when the set of RCs changes. The public keys are unique keys of the RCs, associated with their private keys. These are defined by the PKI used for the system. On similar lines, the details of every RC 201 are entered (403) on the smartcard of the RC 201. The details include biometric details of the owner RC 201, private key of the owner RC 201, public key of the OC and the asset names the OC is authorized to operate. The biometric details and private key are, typically, entered only once. Private Key is the unique key of the RC, as defined by a Public Key Infrastructure (PKI). The public key of the OC may vary dynamically and may be updated as and when the information changes or when the OC changes. The various actions in method 400 may be performed in the order presented, in a different order or simultaneously. Further, in some embodiments, some actions listed in FIG. 4 may be omitted.

FIG. 5 is a flow chart depicting the process of providing access to the remote security lock, according to an embodiment as disclosed herein. The remote security lock 101 is fitted at the location where secure access is required. In order to operate the remote security lock 101, only the OC 301 is required to be present at the location of the lock 101, whereas the RCs 201 may be at locations that are away from the site of the lock 101. The OC 301 on arriving at the site of the remote security lock 101 inserts (501) her smartcard into the smartcard reader 103 that is part of 101. Once her smartcard is inserted, the smartcard reader 103 validates (502) her smartcard. The OC 301 is then prompted (503) to perform a biometric scan on the biometric scanner 104 of the system. The OC presents her biometric scan that may be a fingerprint. Further, the type of biometric means employed could be varied. A check is made (504) to determine if the scanned image matches with that of the image stored on the smartcard of the OC 301. The result of the match is reported to the controlling application of the systems. In case the scan images do not match with that stored on the smartcard of the OC 301, the system sends (505) a message indicating the access is cancelled and access is unauthorized. If the images match, the 2-factor authentication of the OC 301 is complete. It would have been verified that the OC 301 'has' the smartcard and 'is' the person with the necessary biometric data. A message is generated (506) reporting success of match by the smartcard. The message may include details such as OC name, asset name, time and location and not limited to the same. In an embodiment, the location could be pre-programmed for stationary assets. For movable assets, the GPS module 105 is used to track the location. The smartcard of the OC 301 generates (507) a signature of the message using the private key of the OC. The smartcard of the OC 301 then produces (508) an encrypted version of the success message using the private key stored within the smartcard.

Further, a random set of RCs are selected (509) from the RCs stored in the smartcard of the OC and each RC 201 is contacted (510) in the order specified by the system. The RCs 201 may be contacted using the modem 106. They receive an alert (511) informing them of the success of an OC trying to access the security lock 101. The RCs 201 insert (514) their smartcards on their devices in order to authenticate themselves and the RCs' smartcards are validated by their devices. A biometric scan of the RCs 201 is carried out. The RC 201 scans (516) her biometric means on the biometric scanner 104 on the local unit. This data is transferred to the smartcard for matching (517). If there is no match on the data, a negative acknowledgement message is sent to the OC 301. If the biometric data matches, then the 2-factor authentication of the RC 201 is complete and a success message is sent to the RC's device. It would have been verified that the RC 201 'has' the smartcard and 'is' the person with the necessary biometric. The device with RC 201 then decrypts (518) the success message from OC 301. This uses the public key of the OC stored within the smartcard of the RC 201. The signature of the success message from decrypted in the previous step (518) is then computed (519). This also uses the public key of the OC stored within the smartcard of RC 201. A check is made (520) by the RCs 201 to verify the signature of the message computed by them with the signature of the message received from the OC 301. Once the signatures match, the OC 301 and the other details in the message are verified. If there is some mismatch in any information, such as asset name mismatch, the RC 201 sends a (521) negative acknowledge message to OC. This is encrypted and signed by the RC 201, using the private key on her smartcard. On the other hand, if there is a match with the details on the smartcard of the RC 201, the success message from OC 301 is recorded (522) on the RC's device and an acknowledgement message permitting access is generated (523) by the RC 201. The acknowledgement message may be include RC name, asset name, location, time and approval status. The location could be pre-programmed for stationary location of the RC 201. For RCs 201 on the move, a GPS module 105 could be used to determine the location. Then, a signature of the above message is generated (524) by the smartcard of the RC 201 and encrypted (525) using the private key within the smartcard. The encrypted message and signature are returned (526) to the onsite device, through the modem 106. The message from the RC is received (527) on the OC's device.

The acknowledgment messages from the RCs are verified (528, 529, 530) by the OC 301, individually, on her smartcard. The verification involves decrypting the received message and verifying the signature. This uses the public key of the corresponding RC 201. On the failure of verification (530), the access of the lock is cancelled and an unauthorized access event is recorded (505). On the success of verification (530), the message from RC 201 is analyzed (531) to check if it is a positive acknowledgement or negative acknowledgement from RC 201. If the message received from RC 201 is a negative acknowledgement, the access of the lock is cancelled and an unauthorized access event is recorded (505). If the message received from RC 201 is a positive acknowledgement message, the message is stored (532) on the OC's device. This ensures non-repudiation by the RC 201. Further, the process is repeated for each of the RC 201 contacted by OC 301. If all RCs 201 are verified correctly and acknowledgement messages are received from each RC 201, then the lock is enabled for opening (513). The various actions in method 500 may be performed in the order presented, in a different order or simultaneously. Further, in some embodiments, some actions listed in FIG. 5 may be omitted.

In an embodiment, the system may employ random selection of the RCs for the operation of the remote security lock 101. In one of the randomization schemes assume there are N remote controllers. However, at the time of access any non-zero subset of this N could be selected randomly. This system has the advantage of being operationally more efficient as it is more likely that lesser number of RCs 201 would be contacted. Here, the set of RCs 201 registered is fixed (N), but the number of RCs 201 selected varies.

In another embodiment herein, only one of the N RCs may be selected randomly.

The embodiment herein discloses the security strength of the randomization scheme where one in N RCs is employed for operation of the lock 101. Here two controllers are required to open the lock, i.e., one OC 301 and one RC 201.

Even though only one remote controller is required, more than one RC 201 could be registered, say, for instance, two, RC1 and RC2. At the time of opening the lock, the lock device will randomly choose one of the two RCs, RC1 or RC2. The following are the characteristics of such a system.

- The highest security strength of the system is 6, assuming the OC and both RCs are deployed for accessing the lock
- For deterministic outcome (probability 1) of opening the lock an attacker needs to gain access to the OC and both the RCs, i.e., their smartcards and biometrics. The security strength of the system will be the maximum possible
- By choosing to attack the OC and one RC, the attacker has only a certain probability of success. Let us assume that the attacker chooses RC1 or RC2 with equal probability of 0.5. Let us also assume the lock device picks RC1 or RC2 with equal probability of 0.5
- The probability of success in this case is 0.5*0.5+0.5*0.5, which is 0.5. Thus, with this probability the security strength of the lock has been reduced to 4, just attacking the OC and one RC
- The probability of failure is 0.5. The security strength for failure cases is 6, i.e., the maximum measure possible. The logic here is that failure cases could be converted to success cases only by attacking all the RCs.

Thus, the security strength of the system becomes a discrete random variable, s. It takes the values of 4 (with probability 0.5) and 6 (with probability 0.5). The expected value of security strength of the system, E(s), where s is the random variable denoting the security strength is $$E(s) = 0.5*4 + 0.5*6$$
$$= 5$$

In fact, if the attacker is interested in the deterministic (probability of 1) event of gaining access to the controlled resource, he will have to assume a system of security strength 6. The impact of this enhancement is that while the system is operated by lesser RCs, the security strength of the system is closer to the system operated by the full number of RCs.

The 1-in-N remote security lock could be generalized for arbitrary N as follows.

- For deterministic outcome (probability 1) of opening the lock an attacker needs to gain access to all the N RCs
- By choosing to attack only a subset of the RCs, the attacker has only a certain probability of success
- Let us assume that the attacker may choose any subset of N RCs (except NULL and the FULL subsets) with equal probability. Then this probability is 1/(2**N−2). The lock device has the probability of picking each of the N, with a probability of 1/N
- The attacker succeeds if the lock device picks a RC who is in the subset picked by the attacker
- The probability of success in case of k-member subsets is 1/(2**N−2)*k/N*C(N,k), where C(N,k) represents the number of combinations of k elements of a set of N elements. The security measure in these cases is 2(k+1)
- The probability of failure for a k-member subset is 1/(2**N−2)*(N−k)/N*C(N,k), where C(N,k) represents the number of combinations of k elements of a set of N elements. The security measure for cases of failure is 2(N+1), i.e., the maximum measure possible. The logic here is that failure cases could be converted to success cases only by attacking all the RCs.

The security strength random variable takes the values of 4, 6 . . . 2(N+1). The expected value of security strength is $$E(s) = 1/(N*(2**N-2))*\left\{\sum_{k=1}^{k=N-1} k*C(N,k)*2*(k+1) + \sum_{k=1}^{k=N-1} (N-k)*C(N,k)*2*(N+1)\right\}$$
$$= 2(N+1) - (N-1)/(2-1/2**(N-2))$$

For large N, this can be approximated as

~3N/2+5/2

The security strength of the system is proportional to 3N/2, as against 2N of a fully utilized remote controller set of N.

The embodiment herein discloses the security strength of the randomization scheme for selecting k RCs 201 out of the defined N RCs 201. Let an arbitrary number, N, of RCs be registered. The lock device will initially pick a random number from 1 to N, say k. It then picks k random RCs from the registered N. The attacker succeeds only when she picks the same subset as the system. Depending on k, the security strength random variable takes the values of 2(k+1) if the attacker guesses the subset correctly or 2(N+1) otherwise. Each of these events has different probabilities. Further, k varies from 1 to N−1. Thus, the expected value of security strength is $$E(s) = 1/(2**N-2)*\left\{\sum_{k=1}^{k=N-1} 2*(k+1) + \sum_{k=1}^{k=N-1} (C(N,k)-1)*2*(N+1)\right\}$$
$$= 2*(N+1) - N*(N-1)/(2**N-2)$$

For large N, this can be approximated as ~2*(N+1).

It is interesting to note that the security of this system is as good as that of the fully utilised remote controller set of N. Further, it should be noted that there is no assumption on N in the system. It is not known a priori and its knowledge is not coded into the steps of operation of the system. Changing N does not require change in any part of the system. It should be noted that for a deterministic outcome (probability of 1) of breaking the lock, the security strength of the randomized security lock is 2(N+1). Thus, the randomized controller set system provides operational efficiency while not compromising the security.

In an embodiment herein, the smartcard of the OC 301 is programmed with an unrestrained set of RCs 201 as P. At the time of access, N of these RCs 201 are selected randomly and a request for authentication is sent to them. The security strength random variable takes the values of

- 2(N+1) if the attacker picks the same subset of N RCs as the system. The probability of this is $$1\Big/\left(2**P-\sum_{i=0}^{i=N-1}C(P,i)\right)$$

2(N+2) if the attacker picks any subset of size (N+1) that contains the same subset of N RCs as the system. The probability of this is $$C((P-N),1)\Big/\left(2**P-\sum_{i=0}^{i=N-1}C(P,i)\right)$$

2(N+M) if the attacker picks any subset of size (N+M−1) that contains the same subset of N RCs as the system. The probability of this is $$C((P-N),(M-1))\Big/\left(2**P-\sum_{i=0}^{i=N-1}C(P,i)\right)$$

2(P+1) for all subsets of P that do not contain the same subset of N RCs as the system. For all such subsets the maximum value of measure as security is assumed. The probability of this is $$\left(2P-\sum_{i=0}^{i=N-1}C(P,i)-\sum_{i=0}^{i=P-N}C(P-N,i)\right)\Big/\left(2P-\sum_{i=0}^{i=N-1}C(P,i)\right)$$

The expected value of security strength is $$\begin{aligned}E(s)&=1\Big/\left(2**P-\sum_{i=0}^{i=N-1}C(P,i)\right)*\\&\left[\sum_{i=0}^{i=P-N}C(P-N,i)*2*(N+i+1)\right]2*(P+1)\\&=2*(P+1)-2**(P-N)*(P-N)\Big/\left(2**P-\sum_{i=0}^{i=N-1}C(P,i)\right)\end{aligned}$$

The second term is highest in value when N=1. Therefore, the expected measure of security is lowest when N=1. This value is approximately 1.5*(P+1). It is interesting to note that the security of this system is proportional to the total population of the RCs, i.e., P. It should be noted that for a deterministic outcome (probability of 1) of breaking the lock, the security strength of the randomized security lock is 2(P+1).

Embodiments disclosed herein enable the same RCs 201 to be used to provide the required security strength to multiple access points. Thus, the operations could be scaled easily. The scaling requires the addition of one OC 301 per every access point that needs to be controlled simultaneously.

Further, embodiments using randomization of the controllers indicate that choosing random subsets of the controllers allow the security strength of the system to remain nearly close to that of the system with the full complement of the controllers, while enhancing the scalability of the system further, due to the use of lesser number of controllers in providing access to a lock.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims as described herein.

What is claimed is:

1. A method for providing access to a secure location, wherein said access is provided to a first controller present at said secure location and N remote controllers (where N>0) at a plurality of remote locations, said method comprising:

scanning a first smartcard and biometric details of an Onsite Controller (OC), wherein said biometric details comprise at least one of finger prints, an iris scan, and a palm scan of said OC;

verifying said biometric details of said first controller;

generating a first encrypted message using a first private key on the first smartcard;

sending said first encrypted message to at least one of said remote controllers;

scanning a plurality of second smartcards by said remote controllers;

scanning said biometric details by said remote controllers, on receiving said first encrypted message;

verifying said first encrypted message by said remote controllers;

generating a set of second encrypted messages using a respective second private key on respective second smartcards; and sending said set of second encrypted messages to said first controller.

2. The method as claimed in claim 1, wherein a first smartcard comprises said first private key of said first controller.

3. The method as claimed in claim 1, wherein said first smartcard comprises a plurality of public keys in said remote controllers.

4. The method as claimed in claim 1, wherein said second smartcards comprises a plurality of said second private keys in said remote controllers.

5. The method as claimed in claim 1, wherein said second smartcards comprise said public keys of said first controller, wherein said second smartcards belong to said remote controllers.

6. The method as claimed in claim 1, wherein said method further comprises:

verifying said set of second encrypted messages by said first controller;

providing access to said secure location of said first controller when said set of second encrypted messages are determined to be positive acknowledgement messages; and denying access to said secure location to said first controller when said set of second encrypted messages are determined to be a negative acknowledgement message.

7. The method as claimed in claim 1, wherein a non-zero subset of k, 0<k<=N, of said N remote controllers are selected randomly for providing access to said secure location.

8. The method as claimed in claim 1, wherein a constant number N, 0<N<=P of remote controllers is selected randomly from P remote controllers for providing access to said secure location.

9. A system for providing access to a secure location, wherein said access is provided to at least a first controller present at said secure location and N remote controllers (where N>0) at a plurality of remote locations, said system comprising at least one means adapted for:

said first controller scanning a first smartcard;

said first controller scanning biometric details of an Onsite Controller (OC), wherein said biometric details comprise at least one of finger prints, an iris, and a palm of said OC;

verification of biometric details of said first controller;

generating a first encrypted message using a first private key on said first smartcard;

sending said first encrypted message to at least one of said remote controllers;

said remote controllers scanning second smartcards;

said remote controllers scanning their biometric details, on receiving said first encrypted message;

verification of biometric details of said remote controllers;

said remote controllers verifying the first encrypted message;

said remote controllers generating a set of second encrypted messages using a respective second private key on respective second smartcards; and said set of second encrypted messages being sent to said first controller.

10. The system as claimed in claim 9, wherein said system is adapted for using said first private key from said first smartcard of said first controller.

11. The system as claimed in claim 9, wherein said system is adapted for using said public keys of the said plurality of remote controllers present in said first smartcard.

12. The system as claimed in claim 9, wherein said system is adapted for using said second private keys present in respective second smartcards of said remote controllers.

13. The system as claimed in claim 9, wherein said system is adapted for using public key of the said first controller present in said second smartcards of said remote controllers.

14. The system as claimed in claim 9, wherein said system comprises at least one means adapted for:

verifying said set of second encrypted messages by said first controller;

providing access to a secure location to said first controller when said set of second encrypted messages are determined to be positive acknowledgement messages;

denying access to said secure location of said first controller when said set of second encrypted messages is determined to be a negative acknowledgement message.

15. The system as claimed in claim 9, wherein said system is adapted for selecting a non-zero subset of k, 0<k<=N, of said N remote controllers randomly for providing access to the secure location.

16. The system as claimed in claim 9, wherein said system is adapted to accept an unrestricted number P of one or more remote controllers.

17. The system as claimed in claim 9, wherein said system is adapted to select a constant number N, 0<N<=P, of remote controllers randomly from P remote controllers for providing access to said secure location.

* * * * *